US011752533B2

(12) United States Patent
Iza Gallastegui et al.

(10) Patent No.: US 11,752,533 B2
(45) Date of Patent: Sep. 12, 2023

(54) CONTROL METHOD OF A LEVELING MACHINE AND LEVELING MACHINE

(71) Applicant: FAGOR ARRASATE, S.COOP., Arrasate (ES)

(72) Inventors: Gorka Iza Gallastegui, Arrasate-Mondragon (ES); Elena Silvestre Soriano, Arrasate-Mondragon (ES); Jose Manuel Piquer Pérez, Irun (ES); Alberto Mas Acuña, Arrasate-Mondragon (ES)

(73) Assignee: FAGOR ARRASATE, S.COOP., Arrasate (ES)

( * ) Notice: Subject to any disclaimer, the term of this patent is extended or adjusted under 35 U.S.C. 154(b) by 0 days.

(21) Appl. No.: 17/676,913

(22) Filed: Feb. 22, 2022

(65) Prior Publication Data

US 2022/0274148 A1 Sep. 1, 2022

(30) Foreign Application Priority Data

Feb. 26, 2021 (EP) ..... 21382169

(51) Int. Cl.
*B21D 1/02* (2006.01)
*B21B 38/00* (2006.01)

(52) U.S. Cl.
CPC ..... *B21D 1/02* (2013.01); *B21B 38/00* (2013.01)

(58) Field of Classification Search
CPC ..... B21D 1/02; B21B 38/00; B21B 38/08; B21B 2038/002; B21B 37/46; B21B 2275/02; B21B 2275/04; B21B 2275/12
(Continued)

(56) References Cited

U.S. PATENT DOCUMENTS 7,812,558 B2 * 10/2010 Mori ..... B21B 37/46 318/432
8,127,580 B2 * 3/2012 Polatidis ..... B21D 1/02 72/31.07

(Continued)

FOREIGN PATENT DOCUMENTS

CN 201175737 Y 1/2009
CN 104801572 A * 7/2015 ..... B21D 1/02

(Continued)

OTHER PUBLICATIONS

English translate (CN104801572A), retrieved date Jan. 22, 2023.*
European Search Report, EP21382169.7, dated Jul. 22, 2021, 7 pages.

*Primary Examiner* — Matthew Katcoff
*Assistant Examiner* — Mohammed S. Alawadi
(74) *Attorney, Agent, or Firm* — Edell, Shapiro & Finnan, LLC

(57) ABSTRACT

A method that includes moving a sheet material between first and second groups of rolls following a winding path according to a setpoint speed, driving the first group of rolls by a first drive, driving the second group by a second drive independent of the first drive, measuring the speed of the first drive, measuring the speed of the second drive controlling the speed of the first drive by means of a first torque setpoint signal which is a function of a first error signal obtained from the difference between the setpoint speed and the speed of the first drive, and controlling the speed of the second drive by means of a second torque setpoint signal which is a function of a second error signal obtained from the difference between the setpoint speed and the speed of the second drive, and is also a function of an additional torque gain.

14 Claims, 2 Drawing Sheets

(58) Field of Classification Search
USPC ..... 72/160, 162, 163, 164, 165, 10.2, 10.3
See application file for complete search history.

(56) References Cited

U.S. PATENT DOCUMENTS

| | | | | |
|---|---|---|---|---|
| 10,232,419 | B2 * | 3/2019 | Imanari | B21B 37/46 |
| 2012/0047977 | A1 * | 3/2012 | Smith | B21D 1/02 72/14.4 |
| 2016/0271669 | A1 * | 9/2016 | Bergman | B21D 1/02 |

FOREIGN PATENT DOCUMENTS

| | | | |
|---|---|---|---|
| EP | 1951455 | A1 | 8/2008 |
| EP | 2058059 | A1 | 5/2009 |
| EP | 2624978 | A1 | 8/2013 |
| JP | H01317620 | A | 12/1989 |

* cited by examiner

CONTROL METHOD OF A LEVELING MACHINE AND LEVELING MACHINE

CROSS-REFERENCE TO RELATED APPLICATIONS

This application relates to and claims the benefit and priority to European Application No. EP21382169.7, filed Feb. 26, 2021.

TECHNICAL FIELD

The present invention relates to a method used for controlling the operation of a leveling machine for leveling sheet material, and to a leveling machine for leveling sheet material configured for carrying out said method.

BACKGROUND

When manufacturing sheet material, such as a metal strip or sheet metal, the material is generally subjected to cold and hot rolling which provides the material with mechanical properties; however, residual stresses are generated within the material. The release of residual stresses within the material can be achieved by means of processes of straightening, stretch leveling, tension leveling, or by means of the roll leveling in a leveling machine.

The leveling machine has work rolls between which the sheet material is moved following a winding path from the inlet to the outlet of the leveler. The work rolls are arranged in an upper row and a lower row between which the sheet material is moved. By means of rotation of the rolls and by the exerted friction, the sheet material is moved forward at a pre-established setpoint speed. The winding path the material follows through the rolls causes the fibers of the surface of the sheet material to be subjected to tensile and compression stresses, causing a plastic deformation that corrects the defects. Generally, 70-80% of the material exceeds the yield strength during deformation.

The shafts of the rolls of each row of rolls are parallel to one another, but the upper row of rolls is designed with a tilt, such that the deformation induced by the rolls arranged at the inlet of the leveler is greater than that induced by the rolls arranged at the outlet, and therefore the deformation of the material gradually decreases from the inlet towards the outlet as the sheet material moves forward. Therefore, the leveling process is divided into a first part in which the rolls of the inlet of the leveler subject the sheet material to elevated deformations, and a second part in which the rolls of the outlet of the leveler eliminate the curvature that the sheet material has acquired.

The rolls of the leveler can be operated with a single drive, but given that the process is divided into the two parts in which the inlet rolls generate more stress than the outlet rolls, leveling machines formed by a first group of rolls operated by means of a first drive and a second group of rolls operated by means of a second drive which is independent of the first drive, such that each group of rolls of the leveling machine can be controlled independently are known (see for example EP1951455A1, EP2058059A1, and EP2624978A1).

EP2624978A1 shows a control method of a leveling machine which comprises moving a sheet material between a first group of work rolls and a second group of work rolls following a winding path from the first group to the second group according to a setpoint speed, driving the first group of work rolls by means of a first drive, and driving the second group of work rolls by means of a second drive which is independent of the first drive.

The second drive is controlled by means of the setpoint speed and a first torsion torque value of the second drive is measured when the second drive operates at the setpoint speed. A second torsion torque value defining a relationship with the first torsion torque value is subsequently determined, and the second torsion torque value is applied on the first drive maintaining the relationship between the first and the second torsion torque value. The torsion torque value which is applied to a drive based on the torsion torque value which is measured in the other drive is thereby controlled, maintaining a constant relationship between them during the movement of the sheet material.

SUMMARY

One aspect of the invention relates to a control method of a leveling machine which comprises:

- moving a sheet material between a first group of work rolls and a second group of work rolls following a winding path from the first group to the second group according to a setpoint speed,
- driving the first group of work rolls by means of a first drive,
- driving the second group of work rolls by means of a second drive, which is independent of the first drive,
- measuring the speed of the first drive and measuring the speed of the second drive,
- controlling the speed of the first drive by means of a first torque setpoint signal which is a function of a first error signal obtained from the difference between the setpoint speed and the speed of the first drive, and
- controlling the speed of the second drive by means of a second torque setpoint signal which is a function of a second error signal obtained from the difference between the setpoint speed and the speed of the second drive, and is also a function of an additional torque gain.

Another aspect of the invention relates to a leveling machine comprising:

- a first group of work rolls and a second group of work rolls defining a winding path for moving a sheet material from the first group to the second group according to a setpoint speed,
- a first drive for driving the first group of work rolls,
- a second drive for driving the second group of work rolls, which is independent of the first drive, and
- a controller of the drives, wherein the controller is configured for measuring the speed of the first drive and the speed of the second drive, controlling the speed of the first drive by means of a first torque setpoint signal which is a function of a first error signal obtained from the difference between the setpoint speed and the speed of the first drive, and controlling the speed of the second drive by means of a second torque setpoint signal which is a function of a second error signal obtained from the difference between the setpoint speed and the speed of the second drive, and is also a function of an additional torque gain.

The invention allows to obtain in a simple manner an equitable distribution of the stresses generated by the drives of the groups of work rolls, and therefore to obtain an optimized energy consumption of the leveling machine. The two drives are controlled independently by means of a respective torque setpoint signal which is a function of an error signal obtained from the difference between the setpoint speed at which the drives are to be operated for moving the sheet material and the real speed of the drive. The control method thereby measures the real speed of the drives and compares it with the setpoint speed, and the obtained error signal is used for acting on the setpoint torque of the drive, said setpoint torque being directly proportional to the error signal. The second torque setpoint signal applied to the second drive is also a function of an additional torque gain, whereby the setpoint torque applied to the second drive which is arranged at the outlet of the leveling machine is greater than in a conventional leveling machine in which said additional torque gain is not applied.

Therefore, the first group of rolls is used for applying the force required for deforming the sheet material and eliminating residual stresses, whereas the additional torque gain applied to the second drive allows the second group of work rolls to eliminate the curvature the sheet material has acquired when passing through the first group of work rolls, and furthermore allows the second group of work rolls to pull on the sheet material, helping to remove it from the leveler, therefore preventing the first group of rolls from having to perform said pulling effort and being able to concentrate the efforts in the deformation.

These and other advantages and features will become apparent in view of the figures and detailed description.

DETAILED DESCRIPTION

Figure 1:
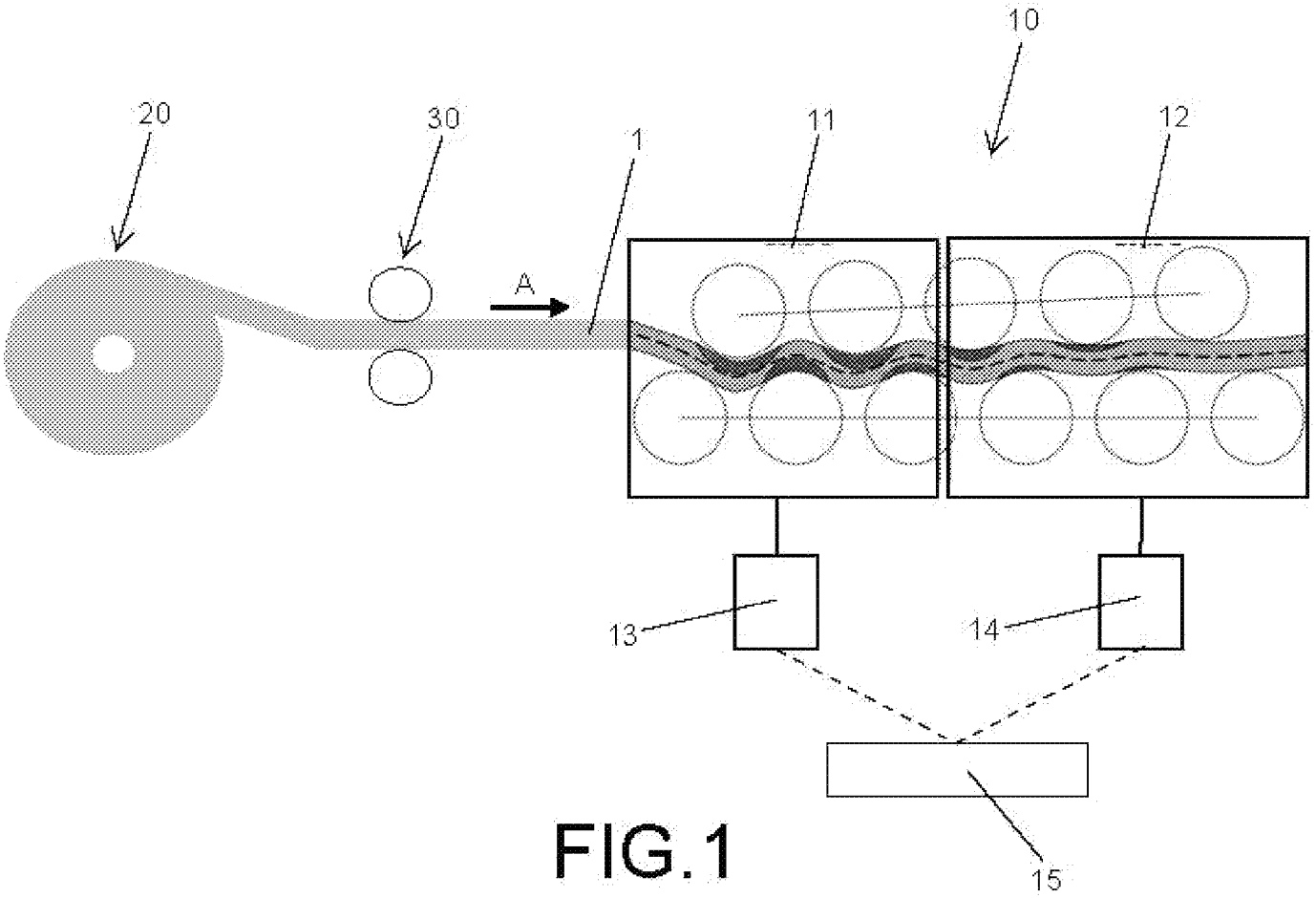
FIG. 1 shows a leveling line for leveling a sheet material using a leveling machine according to an embodiment.

FIG. 1 shows a leveling line for leveling a sheet material 1 comprising a leveling machine 10 for leveling the sheet material 1. The line comprises a reel 20 for supplying the sheet material 1, drive rolls 30 for driving the sheet material 1, and the leveling machine 10 of the sheet material 1. The sheet material 10 is supplied according to a forward movement direction A from the reel 20 towards the leveling machine 10.

The sheet material 1 can be supplied in the form of a continuous strip, as shown in FIG. 1, or in the form of sheet metal.

The drive rolls 30 are a pair of rolls between which the sheet material 1 is forced to pass. As shown in FIG. 1, the drive rolls 30 are arranged upstream of the leveling machine 10, although they can also be arranged downstream of the leveling machine 10, or there can be two sets of drive rolls 30, one upstream of the leveling machine 10 and another one downstream of the leveling machine 10, or there may be no drive rolls 30 and the sheet material 1 is supplied directly from the reel 20 to the leveling machine 10.

The leveling machine 10 comprises a first group of work rolls 11 and a second group of work rolls 12 defining a winding path for moving the sheet material 1 from the first group 11 to the second group 12 according to a setpoint speed V*, a first drive 13 for driving the first group of work rolls 11, a second drive 14 for driving the second group of work rolls 12, which is independent of the first drive 11, and a controller 15 of the drives 13 and 14.

The first drive 13 is a first motor for driving the first group of work rolls 11. The second drive 14 is a second motor for driving the second group of rolls.

The first motor 13 is coupled to the shafts of the rolls of the first group of work rolls 11 by means of a first system of gears and first transmission rods. The second motor 14 is coupled to the shafts of the rolls of the second group of work rolls 12 by means of a second system of gears and second transmission rods. The shaft of the first motor 13 is connected to the first system of gears driving the first transmission rods connected to each roll of the first group of work rolls 11. The shaft of the second motor 14 is connected to the second system of gears driving the second transmission rods connected to each roll of the second group of work rolls 12. The transmission between a motor and the rolls by means of gears and transmission rods is known in leveling machines and not depicted in the figures.

As can be seen in FIG. 1, the work rolls 11 and 12 are arranged in an upper row and a lower row facing one another and separated by a distance for generating the winding path through which the sheet material 1 is moved. Generally, the upper row has an even number n of rolls 11, and the lower row 12 has an uneven number n+1 of rolls 12, nevertheless, the rows can have other configurations with a different number of rolls.

The shafts of the rolls of each row of rolls are parallel to one another, and one of the rows (generally the upper row) is tilted with respect to the other row, such that the separation between the rolls arranged at the inlet of the leveler 10 is less than the separation between the rolls arranged at the outlet of the leveler 10. Therefore, the deformation induced by the rolls arranged at the inlet of the leveler is greater than the deformation induced by the rolls arranged at the outlet; therefore, the deformation of the sheet material 1 gradually decreases from the inlet towards the outlet of the leveling machine as the sheet material 1 moves forward.

Therefore, the leveling process is divided into two parts, the first part corresponds to the one which occurs in the first group of work rolls 11, and the second part corresponds to the one which occurs in the second group of work rolls 12. In the first part, the force exerted by the rolls 11 on the sheet material is greater, and the sheet material 1 develops areas of plastic deformation which increase as the sheet material 1 is bent between the rolls 11, until reaching a maximum plasticized thickness. Due to the strong bends in this first part, a stress profile is generated in the thickness of the sheet material. For that purpose, after the first part, the force exerted on the sheet material 1 decreases until, at the outlet, the rolls 12 barely deform the sheet material 1. The purpose of the second part is to gradually eliminate the curvature of the sheet material 1 and reduce the stress gradient generated in the first part.

It has experimentally been found that when the two drives 13 and 14 are operating at the same speed, the first group of work rolls 11 performs a greater effort than the second group of work rolls 12, such that the torsion torque exerted by the first drive 13 of the first group of work rolls 11 is greater than the torsion torque exerted by the second drive 14 of the second group of work rolls 12. To that end, the purpose of the invention is to obtain a more equitable distribution of the stresses generated by the drive 13, 14 of each group of work rolls 11 and 12, such that the first group 11 carries out its function of deforming the sheet material 1, and the second group 12 carries out its function of eliminating the curvature, but furthermore the second group 12 performs an additional effort for pulling the sheet material 1, helping to remove it from the leveling machine 10.

The control method of the leveling machine 10 comprises:

moving the sheet material 1 between the first group of work rolls 11 and the second group of work rolls 12 following the winding path from the first group 11 to the second group 12 according to a setpoint speed V*, driving the first group of work rolls 11 by means of the first drive 13, driving the second group of work rolls 12 by means of the second drive 14, which is independent of the first drive 13, measuring the speed V1 of the first drive 13 and measuring the speed V2 of the second drive 14, controlling the speed V1 of the first drive 13 by means of a first torque setpoint signal T1* which is a function of a first error signal e1 obtained from the difference between the setpoint speed V* and the speed V1 of the first drive 13, and controlling the speed V2 of the second drive 14 by means of a second torque setpoint signal T2* which is a function of a second error signal e2 obtained from the difference between the setpoint speed V* and the speed V2 of the second drive 14, and is also a function of an additional torque gain.

The setpoint speed V* is pre-established and is the speed at which the drives 13 and 14 are required to operate for moving the sheet material 1 in the forward movement direction A of the leveling line.

Speeds V1 and V2 of the first and second drives 13 and 14 can be measured with encoders coupled to the shafts of the drives, such as magnetic encoders, optical encoders, etc. Alternatively, other detection elements instead of encoders can be used for measuring the speed of the drives.

The speed V1 is the speed measured in the shaft of the first motor 13. The speed V2 is the speed measured in the shaft of the second motor 14.

Figure 2:
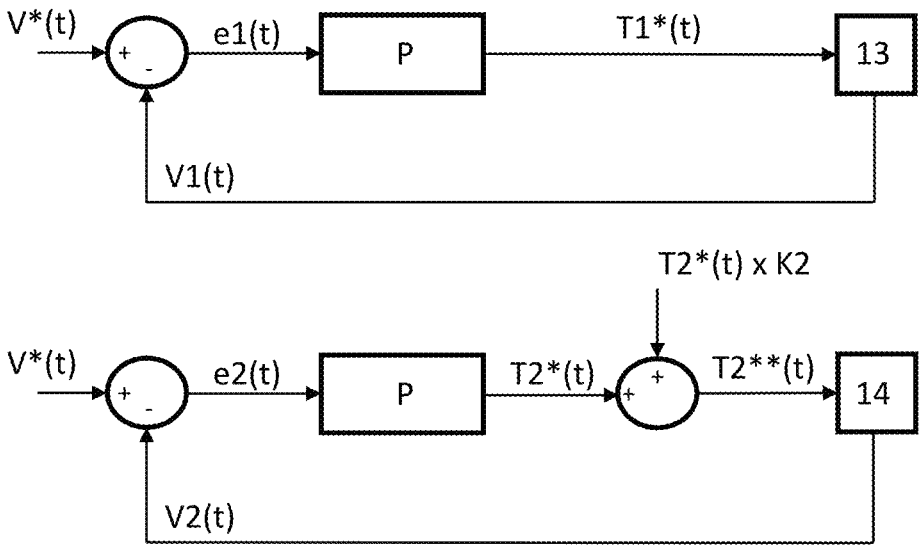
FIG. 2 illustrates a first embodiment of a control method with a proportional controller for controlling the speed of each drive of the leveling machine.

FIG. 2 shows a control diagram with proportional controllers P for controlling the speed V1 and V2 of each drive 13 and 14 of the leveling machine 10. The speed V of each drive is controlled by means of a torque setpoint signal T* which is a function of an error signal e(t) obtained from the difference between the setpoint speed V* and the real speed measured in the drive.

The torque setpoint signal T* of each drive 13 and 14 is directly proportional to the error signal e(t) according to the following expression:

$$T^*(t)=K_p \cdot e(t)$$

wherein Kp is a constant.

The constant Kp is the constant characteristic of proportional controllers P, and it is the same for the two drives.

A proportional controller P is thereby used for applying the torque setpoint signal T* to each drive which is directly proportional to the error signal e(t). The very nature of the proportional controller P means that there is always an error signal e(t) that generates a torque setpoint T* with which it is possible to control the drives 13 and 14. If a proportional integral controller PI is used for generating the torque setpoint signal based on said error signal e(t), the controller PI would tend to achieve zero error in speed (permanent regimen), such that it would not be possible to control the stresses generated by the two drives, whereby in practice the first drive 13 would end up performing a greater effort than the second drive 14.

The speed V1 of the first drive 13 is controlled by means of the first torque setpoint signal T1* which is a function of the first error signal e1 according to the following expressions:

$$T1^*(t)=K_p \cdot e1(t)$$

$$e1(t)=V^*(t)-V1(t)$$

wherein:

T1* is the first torque setpoint signal applied to the first drive 13;

Kp is the constant of the proportional controller P of the first drive 13;

e1 is the first error signal;

V* is the setpoint speed;

V1 is the real speed measured in the first drive 13.

The speed V2 of the second drive 14 is controlled by means of the second torque setpoint signal T2* which is a function of the second error signal e2 according to the following expressions:

$$T2^*(t)=K_p \cdot e2(t)$$

$$e2(t)=V^*(t)-V2(t)$$

wherein:

T2* is the second torque setpoint signal applied to the second drive 14;

Kp is the constant of the proportional controller P of the second drive 14;

e2 is the second error signal;

V* is the setpoint speed;

V2 is the real speed measured in the second drive 14.

As shown in FIG. 2, the method comprises controlling the speed V2 of the second drive 14 by means of a second additional torque setpoint signal T2** according to the following expression:

$$T2^{**}(t)=T2^*(t)+K2T2^*(t)$$

wherein:

T2 is the second additional torque setpoint signal applied to the second drive 14**;

K2 is a constant, and wherein K2T2* is the additional torque gain;

T2* is the second torque setpoint signal applied to the second drive 14.

As shown in FIG. 2, K2 is a constant which is applied to the second torque setpoint signal T2*. Said constant is determined beforehand based on the conditions of the leveling line, and chosen based on the torsion torque required to be applied to the second drive 14 of the second group of rolls 12.

Alternatively, for applying the additional torque gain, it is possible to directly modify the constant Kp of the proportional controller P of the second drive 14 and obtain the second desired torque setpoint signal T2*.

An example of the control method for a time instant in which the setpoint speed V* is 500 rpm, the real speed V1 measured in the first drive 13 is 400 rpm, and the real speed V2 measured in the second drive 14 is 405 rpm is shown below, the constant Kp of the proportional controller for both drives being 8. By applying the control method without the additional torque gain, a first torque setpoint signal T1* of 800 Nm and a second torque setpoint signal T2* of 760 Nm would be obtained.

$$V^*(t)=500 \text{ rpm}; Kp=8 \text{ (the same for the two drives)}$$

$$V1(t)=400 \text{ rpm} \rightarrow e1(t)=100 \text{ rpm and } T1^*(t)=Kp^*e1(t)=800 \text{ Nm}$$

$$V2(t)=405 \text{ rpm} \rightarrow e2(t)=95 \text{ rpm and } T2^*(t)=Kp^*e2(t)=760 \text{ Nm}$$

In this case, the second torque setpoint signal T2* is greater than the first torque setpoint signal T1*. According to this example, an increase in torque in the second drive 14 with respect to the first drive 13 is achieved by adding the additional torque gain to the second drive 14. For example, by applying a constant K2 of 0.3, a second additional torque setpoint signal T2 of 988 Nm would be obtained for the previously indicated time instant, whereby the second drive 14 would perform 23.5% more torque than the first drive 13**, as shown below.

$$K2=0.3$$

$$T2^{**}(t)=760+760*0.3=988\text{ Nm}$$

Figure 3:
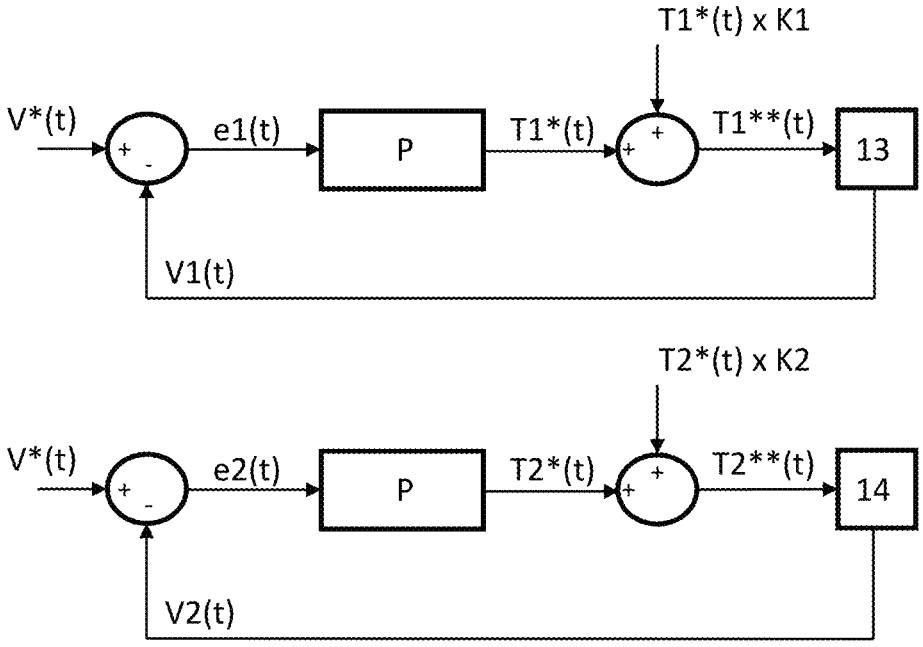
FIG. 3 illustrates a control method according to a second embodiment.

Additionally, if an increase in torque in the first drive 13 is to be obtained, another additional torque gain can be applied to the first torque setpoint signal T1* in the same way that has been described for the second drive 14. To that end, as shown in the example of FIG. 3, the method comprises controlling the speed V1 of the first drive 13 by means of a first additional torque setpoint signal T1** according to the following expression:

$$T1^{**}(t)=T1^{*}(t)+K1T1^{*}(t)$$

wherein:

T1 is the first additional torque setpoint signal applied to the first drive 13**;

K1 is a constant, and wherein K1T1* is the other additional torque gain;

T1* is the first torque setpoint signal applied to the first drive 13.

Generally, K1=0; nevertheless, based on the conditions of the leveling line it may be necessary to apply the other additional torque gain to modify the torque applied to the first drive 13, K1 also being a constant which is determined beforehand based on the conditions of the leveling line.

The leveling machine comprises:

a first group of work rolls 11 and a second group of work rolls 12 defining a winding path for moving a sheet material 1 from the first group 11 to the second group 12 according to a setpoint speed V*, a first drive 13 for driving the first group of work rolls 11, a second drive 14 for driving the second group of work rolls 12, which is independent of the first drive 13, and a controller 15 of the drives 13, 14, the controller 15 being configured for measuring the speed V1 of the first drive 13 and the speed V2 of the second drive 14, controlling the speed V1 of the first drive 13 by means of a first torque setpoint signal T1* which is a function of a first error signal e1 obtained from the difference between the setpoint speed V* and the speed V1 of the first drive 13, and controlling the speed V2 of the second drive 13 by means of a second torque setpoint signal T2* which is a function of a second error signal e2 obtained from the difference between the setpoint speed V* and the speed V2 of the second drive 14, and is also a function of an additional torque gain.

The controller 15 of the leveling machine is configured for carrying out the control method depicted in FIGS. 2 and 3, as previously described. All the features described in connection with the control method are considered as also being described for the machine insofar as they are related to same.

What is claimed is:

1. A method of controlling a leveling machine that is configured to level a sheet material, the leveling machine including a first group of work rolls and a second group of work rolls, the second group of work rolls being located forward of the first group of work rolls in relation to a forward movement direction of the sheet material, the first group of work rolls and the second group of work rolls being configured such that the sheet material follows a first winding path through the first group of work rolls and a second winding path through the second group of work rolls when the sheet material is advanced in the forward movement direction though the leveling machine, the method comprising:

driving the first group of work rolls by use of a first motor to cause the sheet material to follow the first winding path;

driving the second group of work rolls by use of a second motor to cause the sheet material to follow the second winding path, the second motor being independent of the first motor;

measuring a rotational speed (V1) of a shaft of the first motor and controlling the rotational speed (V1) of the shaft of the first motor by use of a first proportional controller that generates a first torque setpoint signal (T1*) which is applied to the first motor, the first torque setpoint signal (T1*) being a function of a first error signal (e1) obtained from a difference between a setpoint rotational speed (V*) and the rotational speed (V1) of the shaft of the first motor; and measuring a rotational speed (V2) of a shaft of the second motor and controlling the rotational speed (V2) of the shaft of the second motor by use of a second proportional controller that generates a second torque setpoint signal (T2*) to which an additional torque gain (K2) is added so that an additional torque setpoint signal (T2**) is applied to the second motor, the second torque setpoint signal (T2*) being a function of a second error signal (e2) obtained from a difference between the setpoint rotational speed (V*) and the rotational speed (V2) of the shaft of the second motor.

2. The method according to claim 1, wherein as a result of the additional torque gain, the rotational speed of the shaft of the second motor is caused to be greater than the rotational speed of the shaft of the first motor.

3. The method according to claim 1, wherein the first and second group of work rolls exert force on the sheet material, the force exerted on the sheet material by the first group of work rolls being greater than the force exerted on the sheet material by the second group of work rolls.

4. The method according to claim 3, wherein as a result of the additional torque gain, a torsion torque exerted by the shaft of the second motor is caused to be greater than the torsion torque that would otherwise be exerted by the shaft of the second motor without the additional torque gain.

5. The method according to claim 1, wherein the torque setpoint signal (T*) of each of the first and second groups of work rolls is directly proportional to the error signal (e) according to the following expression:

$$T^{*}(t)=K_p\cdot e(t)$$

wherein Kp is a constant.

6. The method according to claim 5, wherein the additional torque setpoint signal (T2**) is:

$$T2^{**}(t)=T2^{*}(t)+K2T2^{*}(t)$$

wherein K2 is a constant, and wherein K2T2* is the additional torque gain.

7. The method according to claim 6, further comprising controlling the rotational speed (V1) of the shaft of the first motor by means of a first additional torque setpoint signal (T1**) according to the following expression:

$$T1^{**}(t)=T1^{*}(t)+K1T1^{*}(t)$$

wherein K1 is a constant, and wherein K1T1* is another additional torque gain.

8. A machine configured to level a sheet material, the machine comprising:

a first group of work rolls and a second group of work rolls, the second group of work rolls being located forward of the first group of work rolls in relation to a forward movement direction of the sheet material, the first group of work rolls and the second group of work rolls being configured such that the sheet material follows a first winding path through the first group of work rolls and a second winding path through the second group of work rolls when the sheet material is advanced in the forward movement direction though the leveling machine;

a first motor for driving the first group of work rolls to cause the sheet material to follow the first winding path;

a second motor for driving the second group of work rolls to cause the sheet material to follow the second winding path, the second motor being independent from the first motor:

a first sensor for measuring a rotational speed (V1) of a shaft of the first motor;

a second sensor for measuring a rotational speed (V2) of a shaft of the second motor;

a first proportional controller that is operatively coupled to the first sensor, the first proportional controller configured to control the rotational speed (V1) of the shaft of the first motor by generating a first torque setpoint signal (T1*) which is applied to the first motor, the first torque setpoint signal (T1*) being a function of a first error signal (e1) obtained from a difference between a setpoint rotational speed (V*) and the rotational speed (V1) of the shaft of the first motor;

a second proportional controller that is operatively coupled to the second sensor and configured to control the rotational speed (V2) of the shaft of the second motor by generating a second torque setpoint signal (T2*) to which an additional torque gain (K2) is added so that an additional torque gain setpoint signal (T2**) is applied to the second motor, the second torque setpoint signal (T2*) being a function of a second error signal (e2) obtained from a difference between the setpoint rotational speed (V*) and the rotational speed (V2) of the shaft of the second motor.

9. The machine according to claim 8, wherein as a result of the additional torque gain, the second proportional controller is configured to cause the rotational speed of the shaft of the second motor to be greater than the rotational speed of the shaft of the first motor.

10. The machine according to claim 8, wherein the first and second group of work rolls are configured to exert force on the sheet material, the force exerted on the sheet material by the first group of work rolls being greater than the force exerted on the sheet material by the second group of work rolls.

11. The method according to claim 10, wherein as a result of the additional torque gain, the second proportional controller is configured to cause a torsion torque exerted by the shaft of the second motor to be greater than the torsion torque that would otherwise be exerted by the shaft of the second motor without the additional torque gain.

12. The machine according to claim 8, wherein the torque setpoint signal (T*) of each of the first and second motors is directly proportional to the error signal (e) according to the following expression:

$$T^{*}(t)=K_p\cdot e(t)$$

wherein Kp is a constant.

13. The machine according to claim 12, wherein the additional torque setpoint signal (T2**) is:

$$T2^{**}(t)=T2^{*}(t)+K2T2^{*}(t)$$

wherein K2 is a constant, and wherein K2T2* is the additional torque gain.

14. The machine according to claim 13, wherein the first proportional controller is configured to control the speed (V1) of the first motor by means of a first additional torque setpoint signal (T1**) according to the following expression:

$$T1^{**}(t)=T1^{*}(t)+K1T1^{*}(t)$$

wherein: K1 is a constant, and wherein K1T1* is another additional torque gain.

* * * * *